US005233264A

United States Patent [19]

Tiesler et al.

[11] Patent Number: 5,233,264

[45] Date of Patent: Aug. 3, 1993

[54] ELECTRIC INCANDESCENT LAMP

[75] Inventors: Helmut Tiesler, Cologne; Wilfried Krings, Wurselen; Wilfried Emunds, Alsdorf-Ofden, all of Fed. Rep. of Germany; Hermann Muller, Veldhoven, Netherlands

[73] Assignee: U.S. Philips Corporation, New York, N.Y.

[21] Appl. No.: 540,232

[22] Filed: Jun. 19, 1990

[30] Foreign Application Priority Data

Jul. 1, 1989 [DE] Fed. Rep. of Germany ..... 3921726

[51] Int. Cl.[5] ..... H01J 5/16

[52] U.S. Cl. ..... 313/318; 313/113; 313/110; 362/255

[58] Field of Search ..... 315/113, 318, 315, 110; 439/617, 699; 362/255, 346

[56] References Cited

U.S. PATENT DOCUMENTS

| | | | |
|---|---|---|---|
| 3,631,379 | 12/1971 | Wright et al. | 313/318 |
| 3,898,506 | 8/1975 | Wright | 313/318 |
| 4,485,326 | 11/1984 | Hellwig et al. | 313/318 |
| 4,703,401 | 10/1987 | Ichihara | 362/346 |
| 4,883,434 | 11/1989 | Toyoshima | 313/318 |

*Primary Examiner*—Donald J. Yusko
*Assistant Examiner*—N. D. Patel
*Attorney, Agent, or Firm*—Robert J. Kraus

[57] ABSTRACT

In an electric incandescent lamp having a bulb (1) including a glass pinch (2) which is retained in a metal cap (3) with a rectangular cross-section, the cap is provided with outwardly bent tags (7) at the wider sides (10) of its end facing the bulb (1). The tags (7) each have at their free ends a rim (9) which runs at least substantially parallel to lamp axis (X—X).

2 Claims, 2 Drawing Sheets

ELECTRIC INCANDESCENT LAMP

BACKGROUND OF THE INVENTION

The invention relates to an electric incandescent lamp whose bulb has a glass pinch which is retained in a metal map cap with a rectangular cross-section, which cap is provided with outwardly bent tags at the wider sides of its end facing the bulb.

Such lamps are used, for example, as H1 and H3 motorcar lamps in motor vehicles in such a way that the lamp pinch lies with its wider sides in a horizontal plane. The tags then have the function of cutting off the light radiated by the lamp coil to the rear through an angle of 90°±24°, i.e. through an angle of 45°±12° above and below the horizontal plane, respectively. In this way it is achieved that the rear section of the headlamp reflector, which contains an opening for accommodating the incandescent lamp, is not directly hit by the light from the incandescent coil.

An H3 incandescent lamp of this type is known from DE-OS 26 05 433, corresponding to U.S. Pat. No. 4,122,367, where the tags extend at right angles to the lamp axis.

EP 02 35 855 A1 discloses and H1 incandescent lamp in which the tags run at an angle of approximately 45° to the lamp axis, adapting themselves basically to the more or less conical shape of the bulb end adjoining the pinch.

In both these cases it cannot be avoided that the tags are irradiated by the incandescent coil and reflect the light derived from the incandescent coil sideways onto narrowly delimited spatial sections of the headlamp reflector, from which sections it is reflected to the exterior, as undesired bright spots.

Thus, the present invention has for its object to provide an electric incandescent lamp whose tags provide rear shading through an angle of approximately 90°, but which prevents the bright spots from occuring.

In an electric incandescent lamp of the type described in the opening paragraph, according to the invention, this object is achieved in that the tags each have at their free ends a rim which runs at least substantially parallel to the lamp axis.

Owing to the presence of the rim, the light incident from the incandescent coil on the tags is reflected several times, so that it loses intensity and is substantially reflected back to the incandescent coil itself. In this way, the bright spots are voided.

BRIEF DESCRIPTION OF THE DRAWING

Embodiments of the invention will now be explained in more detail with reference to a drawing, in which.

DESCRIPTION OF THE PREFERRED EMBODIMENTS

Figure 1:
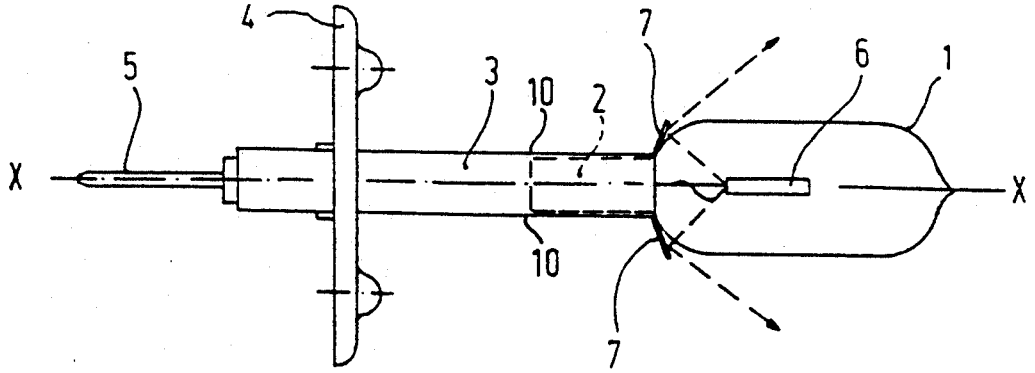
FIG. 1 shows a schematic diagram of a known H1 halogen incandescent lamp for motor vehicle headlamps with tags bent outward through approximately 70°.
Figure 2:
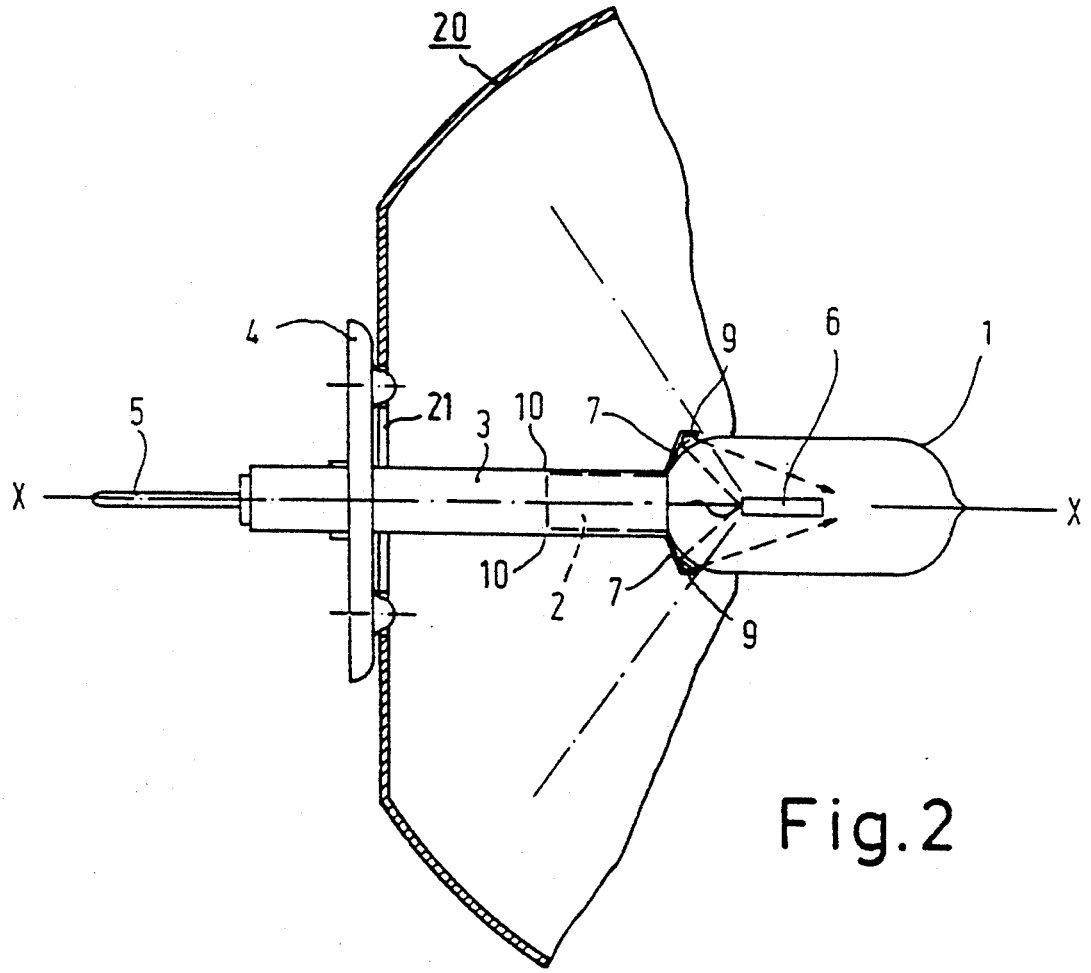
FIG. 2 shows the H1 halogen incandescent lamp according to FIG. 1, of which the tags have rims which run parallel to the lamp axis.

The lamps according to the FIGS. 1 and 2 have a bulb 1, made for example of quartz glass, whose a pinch 2 is held by a rectangular metal cap 3. A prefocus ring 4 is mounted to the cap 3. The reference numeral 5 refers to a connection contact. An incandescent coil 6 is positioned in the lamp bulb 1, which coil extends in the direction of the lamp axis X—X. A reflector 20, of which a portion is shown in FIG. 2, is provided with each of the lamps of FIGS. 1-4 for reflecting light from the coil to the exterior of the lamp.

The caps 3 of the lamps of FIGS. 1 and 2 are provided with outwardly bent tags at the wider sides 10 of their ends facing the bulb, which tags extend at an angle of approximately 70° relative to lamp axis X—X.

According to the invention, each tag 7 has at its free end a rim 9 which runs practically parallel to the lamp axis X—X. The tags 7 with the respective rims 9 cut off the light radiated to the rear by the incandescent coil 6 through an angle of approximately 110° (broken line). The rims 9, in addition, achieve that the light radiated by the incandescent coil 6 onto the tags 7 is reflected several times and finally radiated back for the major part onto the incandescent coil 6, as is shown in FIG. 2 with a broken line indicating the radiation path.

Figure 3:
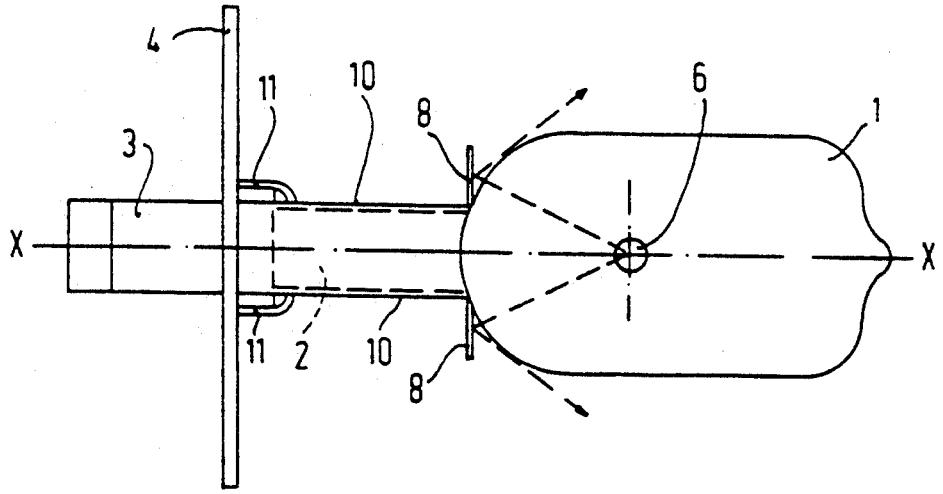
FIG. 3 shows a schematic diagram of a known H3 halogen incandescent lamp for motor vehicle headlamps with tags bent outwards through 90°.
Figure 4:
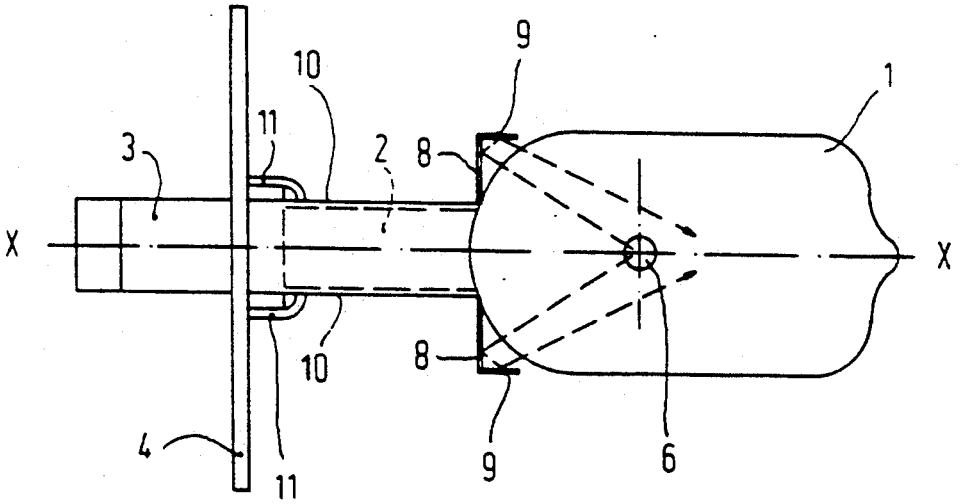
FIG. 4 shows the H3 halogen incandescent lamp according to FIG. 3 of which the tags have been provided with rims.

In FIGS. 3 and 4, in which an H3 halogen incandescent lamp for motor vehicle headlamp reflectors is represented, corresponding parts have the same reference numerals as those in FIGS. 1 and 2. In this case, the incandescent coil 6 is at right angles to the lamp axis X—X. At the wider sides 10 of the cap 3 are present tags 11 which engage in slots of prefocus ring 4.

The wider sides 10 of the cap 3 have perpendicularly outwardly bent tags 8 at their ends facing the bulb. FIG. 4 shows the free ends of these tags 8 bent through right angles, so that rims 9 are formed, which run practically parallel to the lamp axis X—X. The tags 8 with their rims 9 cut off the light from the incandescent coil 6 through an angle of approximately 90° to the rear. In addition, the light incident on the tags 8 is so reflected by the rims 9 that it is thrown back into the lamp bulb 1 (see the broken line indicating the radiation path in FIG. 4).

The rims 9 should run at least substantially parallel to lamp axis X—X, i.e. they may e.g. by directed slightly towards the lamp axis.

We claim:

1. An electric incandescent lamp, having a central longitudinal axis, for use with a reflector, said lamp comprising:
   a. a bulb disposed about the axis and including a pinch at an axial end thereof;
   b. an incandescent light source contained in the bulb; and
   c. a metal lamp cap secured to the pinch, said lamp cap including:
      (1) an axially extending portion secured to the pinch;
      (2) a tag portion extending from the axially extending portion transversely of the axis for reflecting light emitted by the incandescent light source away from said axial end of the bulb; and
      (3) a rim portion extending from the tag portion substantially parallel to the axis for reflecting emitted light which is reflected toward the reflector by the tag portion away from the reflector.

2. An electric incandescent lamp as in claim 1 where the pinch and the axially extending portion of the metal lamp cap have substantially rectangular cross sections, said axially extending portion having two longer sides and two shorter sides, one tag and rim portion extending from at least each of said two longer sides.

* * * * *